United States Patent [19]

Becker et al.

[11] Patent Number: 4,495,277

[45] Date of Patent: Jan. 22, 1985

[54] PHOTOGRAPHIC SILVER HALIDE EMULSION

[75] Inventors: Manfred Becker, Leverkusen; Sieghart Klötzer; Erik Moisar, both of Cologne, all of Fed. Rep. of Germany

[73] Assignee: Agfa Gevaert Aktiengesellschaft, Leverkusen, Fed. Rep. of Germany

[21] Appl. No.: 519,150

[22] Filed: Aug. 1, 1983

[30] Foreign Application Priority Data

Aug. 12, 1982 [DE] Fed. Rep. of Germany ..... 3229999

[51] Int. Cl.[3] ..... G03C 1/02

[52] U.S. Cl. ..... 430/567; 430/569; 430/543

[58] Field of Search ..... 430/409, 410, 411, 596, 430/597, 598, 567, 569

[56] References Cited

U.S. PATENT DOCUMENTS

| | | | |
|---|---|---|---|
| 3,317,322 | 5/1967 | Porter | 430/603 |
| 3,622,318 | 11/1971 | Evans | 96/22 |
| 3,850,637 | 11/1974 | Evans | 430/409 |
| 3,935,014 | 1/1976 | Klötzer et al. | 430/567 |
| 3,957,488 | 5/1976 | Klötzer et al. | 430/567 |
| 4,431,730 | 2/1984 | Urabe et al. | 430/564 |
| 4,431,731 | 2/1984 | Sugimoto et al. | 430/409 |

FOREIGN PATENT DOCUMENTS

| | | |
|---|---|---|
| 1027146 | 4/1966 | United Kingdom . |

*Primary Examiner*—Mary F. Downey

*Attorney, Agent, or Firm*—Connolly and Hutz

[57] ABSTRACT

Surface-sensitized silver halide grains having a core/-shell structure show improved properties.

10 Claims, No Drawings

PHOTOGRAPHIC SILVER HALIDE EMULSION

This invention relates to a photographic silver halide emulsion containing silver halide grains which have a core/shell structure, the silver grains being chemically sensitised at the surface thereof. The present invention also relates to a photographic recording material comprising a layer support and at least one layer containing a silver halide emulsion according to the present invention.

The production of silver halide emulsions, the grains of which have a high internal sensitivity is generally known. In this connection, reference may be made, for example, to the emulsions produced by the conversion method in accordance with U.S. Pat. No. 2,592,250 and to emulsions, the silver halide grains of which have a core/shell structure, as known, for example, from DE-AS No. 1,169,290 and from GB-Pat. No. 1,027,146.

It is also known that emulsions containing grains of high internal sensitivity may be chemically sensitised at the surface thereof in the conventional manner. In this connection, reference may be made, for example, to U.S. Pat. No. 3,206,313, column 1, lines 23 et seq. In this case, the surface sensitivity of converted emulsions is increased by conventional chemical sensitisation. U.S. Pat. No. 3,317,322 relates to silver halide emulsions having a core/shell structure and high internal sensitivity which are chemically sensitised at the surface thereof. It is known from U.S. Pat. No. 2,756,148 that a converted emulsion may be produced, for example, by initially precipitating a silver chloride/bromide emulsion and subsequently converting that emulsion by bromide. The converted emulsion obtained is then sensitised at its surface using a sulphur sensitising agent. It is also known from U.S. Pat. No. 2,983,608 that converted emulsions produced in accordance with U.S. Pat. No. 2,592,250 may be chemically sensitised and used together with colour couplers in recording materials. Furthermore, corresponding materials are also described in DE-PS No. 2,112,729 and in U.S. Pat. No. 3,622,318.

One disadvantage of known emulsions containing grains having high internal sensitivity which are chemically sensitised in the conventional manner at the surface thereof lies in the fact that the sensitometric properties thereof and, in particular, the behaviour thereof under pressure, especially during processing in the developer, are still not satisfactory. It has been found that surface-sensitised converted emulsions in particular are sensitive to pressure during processing are readily show signs of pressure when subjected to pressure, for example by transporting means, immediately after the beginning of development.

The phenomenon that fogging may generally be produced by the effect of pressure is well known. In this connection, reference may be made, for example, to T. H. James, "The Theory of the Photographic Process", 4th Edition, Macmillan Publishing Co., Inc., New York, page 24. According to published British Patent Application No. 2,023,863, the effects of pressure in the dry state are said to be avoided by the addition of certain compounds. According to DE-PS No. 2,112,729 and U.S. Pat. No. 3,622,318, an improvement over emulsions which do not have internal sensitivity is said to be obtained by using surface-sensitised converted emulsions.

However, the protection of photographic recording materials against the effects of pressure, particularly against fogging under pressure in the wet state, is still unsatisfactory.

An object of the present invention is to provide chemically surface-sensitised silver halide emulsions having improved properties. More particularly, an object of the present invention is to provide such emulsions which are characterised by improved behaviour with respect to pressure and by improved sensitivity.

A new photographic silver halide emulsion containing silver halide grains which have a core/shell structure which are chemically sensitised at the surface thereof has now been found. According to the present invention, the silver halide grains contain at least one layer containing at least 25 mole percent of silver chloride, the silver chloride content of the silver halide grain as a whole amounting to less than 30 mole percent. The emulsion according to the present invention is chemically ripened at its surface to such an extent that the ratio R of the density $D_r$ obtainable after surface ripening to the density $D_u$ obtainable with the as yet non-surface-ripened, but otherwise identical, emulsion amounts to at least 3, the ratio R being determined by applying the ripened emulsion and the unripened emulsion to a layer support in exactly the same way, exposing them and then developing them for 17 minutes at 20° C. in a developer of the following composition:

| | |
|---|---|
| ascorbic acid | 10 g |
| p-methylaminophenol | 2.4 g |
| $Na_2CO_3$ (sicc.) | 10 g |
| KBr | 2.0 g |
| water to 1000 ml | |

and $D_r$ being the value of 90% of the maximum density and $D_u$ being obtained by exposure of the as yet unripened emulsion to the extent which leads to the density $D_r$ in the case of ripened emulson.

Silver halide grains having a core/shell structure are to be understood to be silver halide grains which comprise a core and at least one surrounding shell which differs therefrom in its properties. Naturally, a silver halide grain of the type in question need not have just one, but may have several shell layers around the core. In one preferred embodiment, preparation of the emulsion is carried out for a while at least under reducing conditions. In one particularly preferred embodiment of the present invention, the core and/or at least one shell is produced at a pAg of at most 7, more preferably below 5.0. However, it is also possible to establish the reducing conditions by using conventional reducing agents. Suitable reducing agents are, for example, hydrazine, optionally in hydrate form, hydrazine derivatives, ascorbic acid, hydroquinone or formamidine sulphinic acid (thiourea dioxide). Inorganic reducing agents, such as tin-(II)-chloride, or the thiourea dioxide mentiond above are preferably used. The quantity of reducing agent added may vary within wide limits and depends upon the type of reducing agent and silver halide used and upon the required effect. According to the present invention, the quantity of reducing agent used should generally not exceed $0.75\times10^{-2}$ milliequivalents per g of already precipitated silver ion. In most cases, quantities of from 0.1 to 10 mg/kg of silver nitrate have proved to be adequate. In the case of thiourea dioxide, quantities of from 0.5 to 7.0 mg for example, are sufficient. The emulsions according to the present invention are preferably monodisperse. In general, at least 80% of the emulsion grains have a diameter which deviates by ±20% from the average grain diameter. It is, of course, possible to use a mixture of monodisperse emulsions according to the present invention differing in the grain size thereof in recording materials. In one preferred embodiment, the silver halide grains are regular in the sense that they do not contain crystal defects through twinning.

The silver halide grains of the emulsion according to the present invention contain at least one layer rich in silver chloride, i.e. of which at least 25 mole percent of the silver halide consists of silver chloride. Generally, the arrangement of the silver chloride-rich layer in the silver halide grain is not critical. This layer may be present either as the core, as a shell within the silver halide grain or as an outer shell. The layer rich in silver chloride is preferably situated inside the grain and preferably at least 0.05 μm below the surface. The transition from the silver chloride-rich layer to layers having a different silver halide composition may either be in the form of a clear phase boundary or may be continuous.

In addition to silver chloride, the silver halide grains preferably contain silver bromide or mixtures of silver bromide and silver iodide.

The silver halide grains may assume the known forms, for example, cubic, octahedral or even a combination of tetrahedral and decahedral. The absolute value of the mean grain size may vary within wide limits. Depending on the application envisaged, it is possible to use both fine-grain silver halide emulsions having a mean diameter of less than 0.5 μm, preferably less than 0.3 μm, and also coarser emulsions having a mean grain diameter of, in particular, from 0.5 to 2 μm.

The silver halide emulsions according to the present invention may be produced by methods known for the production of silver halide emulsions having a core/-shell structure. It is preferred to use double jet processes where maintenance of the necessary pAg and pH values may best be monitored. In general, a pAg of from 10 to 7 and a pH of from 4.5 to 7 are maintained during preparation of the emulsion by known precipitation methods. According to the present invention, however, at least one layer of the silver halide grain is prepared under reducing conditions, more particularly at a pAg of at most 7. In addition, complexes of polyvalent cations, for example those of Rh, Pd, Ir and Pt, may be present during preparation of the emulsion. The individual precipitation stages involved in preparation of the emulsion may be separately carried out either in immediate succession or even at intervals. On completion of precipitation, the silver halide grains may be treated in known manner with oxidising agents, for example $Hg^{2+}$- or $Fe^{3+}$-compounds, to suppress fogging.

In one preferred embodiment, the silver halide grains according to the present invention have a core consisting essentially of silver bromide, at least one layer rich in silver chloride (silver chloride content at least 30 mole percent) and a layer essentially containing silver bromide which is situated further away from the core than the layer rich in silver chloride and which contains less silver chloride than the layer rich in silver chloride.

The conventional sensitisers may be used for chemically sensitising the silver halide grains at the surface thereof. Sulphur-containing compounds, for example allyl isothiocyanate, allyl thiourea and thiosulphates, are particularly preferred.

Other suitable chemical sensitisers are reducing agents, for example the tin compounds described in Belgian Pat. Nos. 493,464 or 568,687, also polyamines, such as diethylene triamine or aminomethyl sulphinic acid derivatives, for example according to Belgian Pat. No. 547,323. Other suitable chemical sensitisers include noble metals and noble metal compounds, such as gold, platinum, palladium, iridium, ruthenium or rhodium. This method of chemical sensitisation is described in the article by R. Koslowsky in Z.Wiss.Phot., 46, 65–72, (1951). It is also possible to sensitise the emulsion using polyalkylene oxide derivatives, for example polyethylene oxide having a molecular weight of from 1000 to 20,000, and also using condensates of alkylene oxides and aliphatic alcohols, glycols, cyclic dehydration products of hexitols, using alkyl-substituted phenols, aliphatic carboxylic acids, aliphatic amines, aliphatic diamines and amides. The condensates have a molecular weight of at least 700, preferably more than 1000. To obtain particular effects, the sensitisers may, of course, be used in combination, as described in Belgian Pat. No. 537,278 and in British Pat. No. 727,982.

The present invention also relates to a recording material comprising a layer support, at least one photosensitive silver halide emulsion layer and, optionally, other layers, characterised in that an emulsion according to the present invention is present in at least one layer. The recording material in question is preferably a colour photographic recording material.

Although silver halide emulsions containing silver halide grains which have a core/shell structure and a layer relatively rich in silver chloride are known from German Offenlegungsschrift Nos. 2,308,239 and 2,332,802 and from U.S. Pat. Nos. 3,935,014 and 3,957,488, these known emulsions are only slightly chemically sensitised at the surface thereof, if at all, and lead to only a very low density when applied to a support, exposed and developed in a surface developer in the conventional manner.

In addition, German Offenlegungsschrift No. 2,203,462 and U.S. Pat. No. 3,892,574 describe silver halide emulsions in the precipitation or physical ripening of which a pAg of from 7 to 0 is at least temporarily maintained. The emulsions obtained may be chemically sensitised at the surface thereof and have a narrow grain size distribution. In addition, the emulsions may have a core/shell structure, in which case the core of the silver halide grain may be chemically sensitised and the shell fogged by conventional methods in order to obtain emulsions of the so-called direct-positive type. However, there is no reference to the use of emulsions having a core/shell structure which in accordance with the present invention, contain a layer relatively rich in silver chloride and are chemically sensitised at the surface thereof.

Emulsions containing silver halide grains and certain diketo compounds are known from German Offenlegungsschrift No. 3,144,867. The silver halide grains may contain various layers and, in addition, may be precipitated at a pAg of from 5 to 11. German Offenlegungsschfit No. 3,144,313 describes silver halide emulsions containing reduction-sensitised grains which contain phenol derivatives to improve storage stability. The silver halide grains may be produced by various processes, inter alia, by a core-shell process.

The present invention may be used both for the production of black-and-white and also coloured photographic images. Coloured photographic images may be produced, for example, on the principle of chromogenic development in the presence of colour couplers which react with the oxidation product of dye-producing p-phenylene diamine developers to form dyes.

The colour couplers may be added to the colour developer. In one preferred embodiment, the photographic material itself contains the conventional colour couplers which are generally incorporated in the silver halide layers. Thus, the red-sensitive layer, for example, may contain a non-diffusing colour coupler for producing the cyan component colour image, generally a coupler of the phenol or $\alpha$-naphthol type. The green sensitive layer may contain, for example, at least one non-diffusing colour coupler for producing the magenta component colour image, normally a colour coupler of the 5-pyrazolone or imidazolone type. The blue-sensitive layer may contain, for example, a non-diffusing colour coupler for producing the yellow component colour image, generally a colour coupler containing an open-chain ketomethylene group. Colour couplers of this type are known in large numbers and are described in a number of patents. Reference may be made in this connection, for example, to the publications entitled "Farbkuppler (Colour Couplers)" by W. Pelz in "Mitteilungen aus den Forschungslaboratorien der Agfa, Leverkusen/Munchen", Vol. III, page 111, (1961); K. Venkataraman in "The Chemistry of Synthetic Dyes", Col. 4, 341 to 387, Academic Press, (1971); and T. H. James, "The Theory of the Photographic Process", 4th Edition pages 353 to 362. The colour couplers may be, for example, 6-, 4- and 2-equivalent couplers, including the so-called white couplers, which do not produce a dye on reaction with colour developer oxidation products, and also DIR-couplers.

It is possible, if required, to use colour coupler mixtures in order to obtain a desired colour or a desired reactivity. For example, water-soluble couplers may be used in combination with hydrophobic water-insoluble couplers.

The emulsions according to the present invention are particularly suitable for colour photographic recording materials containing at least one silver halide emulsion layer unit for recording light of each of the three spectral regions, red, green and blue. Each of these layer units may comprise a single silver halide emulsion layer or even several silver halide emulsion layers. Colour photographic recording materials containing double layers for the various regions of the spectrum are known, for example, from U.S. Pat. Nos. 3,663,228; 3,849,138 and 4,184,876.

The emulsions may be optically sensitised in known manner, for example using the conventional polymethine dyes, such as neutrocyanines, basic or acid carbocyanines, rhodacyanines, hemicyanines, styryl dyes, oxonols and the like. Such sensitisers are described in F. M. Hamer's book entitled "The Cyanine Dyes and Related Compounds", (1964). In this connection, reference may be made in particular to "Ullmanns Enzyklopadie der technischen Chemie", 4th Edition, Vol. 18, pages 431 et seq.

Particularly suitable stabilisers are azaindenes, preferably tetra- or penta-azaindenes, particularly those substituted by hydroxyl or amino groups. Such compounds are described, for example, in the Article by Birr, in Z.Wiss.Phot., 47, (1952), pages 2–58. Other suitable stabilisers include heterocyclic mercapto compounds, for example phenyl mercapto tetrazole, quaternatry benzthiazole derivatives and benzotriazole.

The conventional layer supports may be used for the materials according to the present invention, including for example supports of cellulose esters, such as cellulose acetate or cellulose acetobutyrate, also polyesters, particularly polyethylene terephthalate, or polycarbonates, particularly based on bisphenylol propane. Other suitable supports are paper supports which may optionally contain water-impermeable polyolefin layers, for example of polyethylene, or polypropylene, and also supports of glass or metals.

Suitable protective colloids and binders for the layers of the recording material are the conventional hydrophilic film-forming agents, for example proteins, particularly gelatin, alginic acid or derivatives thereof, such as esters, amides or salts, cellulose derivatives, such as carboxymethyl cellulose and cellulose sulphates, starch or derivatives thereof or hydrophilic synthetic binders, such as polyvinyl alcohol, partially hydrolysed polyvinyl acetate, polyvinyl pyrrolidone and others. The layers may also contain, in admixture with the hydrophilic binders, other synthetic binders in dissolved or dispersed form, such as homopolymers or copolymers of acrylic or methacrylic acid or derivatives thereof, such as esters, amides or nitriles, and also vinyl polymers, such as vinyl esters or vinyl ethers.

The layers of the photographic material may be hardened in the conventional way, for example using formaldehyde, using hardeners of the epoxy-type, the heterocyclic ethylene imine-type and the acrylolyl-type. It is also possible to harden the layers by the process according to German Offenlegungsschrift No. 2,218,009 to obtain colour photographic materials which are suitable for high temperature processing. It is also possible to harden the photographic layers or rather the colour photographic multilayer materials using hardeners of the diazine, triazine or 1,2-dihydroquinoline series or using hardeners of the vinyl sulphone-type.

Regarding other suitable additives for the colour photographic recording materials according to the present invention or for any of its layers, reference may be made to the article in the Journal "Product Licensing Index", Vol. 92, December, 1971, pages 107 to 110.

Conventional, known black-and-white developer compounds, such as the hydroxyl benzenes and 3-pyrazolidones, are suitable for black-and-white development.

Suitable colour developer substances for the material according to the present invention are, in particular, those of the p-phenylene diamine-type, for example 4-amino-N,N-diethyl aniline hydrochloride; 4-amino-3-methyl-N-ethyl-N-$\beta$-(methane sulphonamido)-ethyl aniline sulphate hydrate; 4-amino-3-methyl-N-ethyl-N-$\beta$-hydroxyethyl aniline sulphate; 4-amino-3-$\beta$-(methane sulphonamido)-ethyl-N,N-diethyl aniline hydrochloride; 4-amino-N-ethyl-N-(2-methoxyethyl)-m-toluidine-di-p-toluene sulphonic acid and N-ethyl-N-$\beta$-hydroxyethyl-p-phenylene diamine.

Other suitable colour developers are described, for example, in J.Amer.Chem.Soc., 73, 3100 (1951) and in G. Haist, Modern Photographic Processing, 1979, John Wiley and Sons, New York, Pages 545 et seq.

After colour development, the material is bleached and fixed in the conventional manner. Bleaching and fixing may be carried out separately or even together. Suitable bleaching agents are the conventional compounds, for example $Fe^{3+}$-salts and -complex salts, such as ferricyanides, dichromates, water-soluble cobalt complexes, etc. It is particularly preferred to use iron- (III)-complexes of aminopolycarboxylic acids, especially, for example, ethylene diamine tetraacetic acid, nitrilotriacetic acid, iminodiacetic acid, N-hydroxyethyl ethylene diamine triacetic acid, and of corresponding phosphonic acids.

EXAMPLE 1

Emulsion A according to the present invention

A silver bromide emulsion having an average particle size of 0.25 μm was prepared over a period of 15 minutes by the simultaneous pAg-controlled introduction of a KBr solution and a $AgNO_3$-solution into a 2.1% gelatin solution heated to a temperature of 63° C. Thereafter, the crystals of this starting emulsion were doubled in diameter by the addition of more KBr solution and $AgNO_3$ solution at pAg 6.0. An AgCl shell was then precipitated onto the crystals by the simultaneous pAg-controlled introduction of KCl solution and $AgNO_3$ solution. Precipitation was then continued by the simultaneous introduction of KBr solution and $AgNO_3$ solution, an AgBr-shell being applied to the previously precipitated AgCl-shell. The average particle diameter of the crystals obtained amounted to 0.65 μm. 15% of the crystals were outside a range of 0.65±(0.1.0.65 μm), in other words the emulsion obtained was homodisperse. The total AgCl content amounted to 10 mole percent.

The emulsion was freed from the soluble salts in the conventional manner by washing and subsequently adjusted to a pAg of 7.8. The emulsion was then ripened for 120 minutes at 45° C. by the addition of sodium thiosulphate pentahydrate in a quantity of 80μ mole/-mole of silver and 42.5 mg of a triazaindolizine.

Comparison Emulsion K

The comparison emulsion K is a converted emulsion produced by a modified version of the method known from U.S. Pat. No. 2,592,250. According to U.S. Pat. No. 2,592,250, converted emulsions having a relatively wide grain size distribution are generally obtained. A distribution range in which approximately 70% of the grains have a diameter deviating by more than 10% from the mean diameter is typical. In order for comparison to obtain a converted emulsion having a grain size distribution as narrow as that of emulsion A according to the present invention, a converted emulsion having a narrow grain size distribution was prepared by initially precipitating a monodisperse silver chloride emulsion (grain diameter 0.63 μm) by controlled double jet processes. This emulsion was converted by the addition of an equivalent quantity of potassium bromide for 26 minutes at 60° C. The converted emulsion obtained (emulsion K) still contained 10 mole percent of silver chlroide. The average grain diameter amounted to 0.67 μm, 17% of the grains having a diameter deviating by more than 10% from the average diameter. Emulsion A according to the present invention and comparison emulsion K are comparable in the dispersity thereof. Emulsion K was chemically ripened in the same way as emulsion A.

Both emulsions were applied in the same way to a cellulose triacetate layer support, exposed behind a grey wedge and developed with a standard black-and-white developer. The sensitometric values are shown in Table 1 below:

TABLE 1

| Emulsion | Speed | Fog | $D_{max}$ |
|---|---|---|---|
| A (invention) | 290 | 0.07 | 1.38 |
| K (comparison) | 100 | 0.10 | 1.40 |

A doubling of the value quoted in the "speed" column corresponds to a doubling of speed itself.

It may be seen from Table 1 that emulsion A according to the present invention shows distinctly higher speed for less fog.

EXAMPLE 2

Emulsion B according to the present invention

An emulsion B according to the present invention was prepared in the same way as emulsion A in Example 1, except that the precipitation of silver bromide onto the AgCl-containing zone was carried out at pAg 4.5 and not at pAg 6. Precipitation of the other layers and all other measures were carried out in the same way as described in Example 1. Sensitometric evaluation produced the results shown in Table 2 below, from which the increase in speed by precipitation at a lower pAg may clearly be seen.

TABLE 2

| Emulsion | Speed | Fog |
|---|---|---|
| B (invention) | 445 | 0.07 |

EXAMPLE 3

This Example shows that emulsion A produced in accordance with the present invention is far less sensitive to pressure in the wet state than comparison emulsion K. Emulsions A and K according to Example 1 were used for the layer combination described in the following.

For a layer combination according to the present invention, 1 kg of emulsion A is mixed with a dispersed coupler. The coupler dispersion is prepared from 50 mMoles of a standard yellow coupler, 13.5 ml of tricresyl phosphate and 50 ml of ethyl acetate dispersed in 300 ml of a 12% gelatin solution in the presence of 2 g of sodium dodecyl benzene sulphonate. The mixture of the dispersed coupler and silver halide emulsion obtained is applied to a standard layer support and processed as follows:

| Colour development process | Temperature (°C.) | Time |
|---|---|---|
| 1. Colour development | 33 | 3 mins. 30 s |
| 2. Bleach-fixing | 33 | 1 min. 30 s |
| 3. Washing with water | 26 | 2 mins. |
| 4. Drying | | |

The corresponding baths have the following compositions:

| Colour developer solutions | |
|---|---|
| Benzyl alcohol | 15 ml |
| Potassium carbonate | 30 g |
| Potassium bromide | 0.5 g |
| Hydroxylamine sulphate | 2 g |
| Sodium sulphite | 2 g |
| Diethylene triamine | 1 g |
| N—ethyl-N—β-methane-sulphonamido-ethyl-3-methyl-4-aminoaniline sulphate | 4.5 g |

-continued

| | |
|---|---|
| made up with water to | 1 l |
| Bleach/Fixing solution | |
| Ammonium thiosulphate (70%) | 150 ml |
| Sodium sulphite | 5 g |
| Na[Fe (EDTA)] | 40 g |
| EDTA | 4 g |
| made up with water to | 1 l |

A comparison material was prepared in the same way, except that comparison emulsion K was used instead of emulsion A according to the present invention.

To test sensitivity to pressure, a pressure trace was applied to both materials immediately after the beginning of development. On completion of processing, the density D of the dried materials was evaluated using a microdensitometer. The results set out in Table 3 below show that the materials according to the present invention are far less prone to pressure fogging in the wet state. The stages X, Y and Z indicated in Table 3 stand for different exposure intensities.

TABLE 3

| | Densities D of | | | | | |
|---|---|---|---|---|---|---|
| | Comparison Material Emulsion K | | | Material according to the present invention Emulsion A | | |
| Stage | I | II | Δ D | I | II | Δ D |
| X | 0.09 | 0.18 | 0.09 | 0.08 | 0.08 | 0 |
| Y | 0.69 | 0.79 | 0.10 | 0.65 | 0.67 | 0.02 |
| Z | 1.17 | 1.23 | 0.06 | 1.19 | 1.20 | 0.01 |

I: Density without pressure≠II: Density after pressure (in pressure trace)

We claim:

1. A photographic silver halide emulsion containing silver halide grains which have a core/shell structure and which are chemically sensitised at the surface thereof to provide density and speed, wherein, in the silver halide grains, at least one layer contains at least 25 mole percent of silver chloride and wherein the total content of silver chloride amounts to less than 30 mole percent and wherein the emulsion is chemically ripened at its surface to such an extent that the ratio R of the density $D_r$ obtainable after surface ripening to the density $D_u$ obtainable with the as yet non-surface-ripened, but otherwise identical, emulsion amounts to at least 3, the ratio R being determined by applying the ripened emulsion and the unripened emulsion to a layer support in exactly the same way, exposing them and then developing them for 17 minutes at 20° C. in a developer of the following composition:

| | |
|---|---|
| ascorbic acid | 10 g |
| p-methylaminophenol | 2.4 g |
| $Na_2CO_3$ (sicc.) | 10 g |
| KBr | 2.0 g |
| water to 1000 ml | |

and $D_r$ being the value of 90% of the maximum density and $D_u$ being obtained by exposure of the as yet unripened emulsion to the extent which leads to the density $D_r$ in the case of ripened emulsion.

2. A photographic silver halide emulsion as claimed in claim 1, wherein the preparation of the emulsion is carried out for a while at least under reducing conditions.

3. A photographic silver halide emulsion as claimed in claim 1, wherein a pAg of at most 7 is maintained for a while at least during preparation of the emulsion.

4. A photographic silver halide emulsion as claimed in claim 1, wherein the emulsion is monodisperse and the silver halide grains are regular.

5. A photographic silver halide emulsion as claimed in claim 1, wherein the silver halide grains contain a core which consists essentially of silver bromide, at least one layer containing at least 30 mole percent of silver chloride and at least one outer layer consisting essentially of silver bromide.

6. A photographic silver halide emulsion as claimed in claim 1, wherein the total silver chloride content amounts to at most 20 mole percent.

7. A photographic silver halide emulsion as claimed in claim 1, wherein at least one layer of the silver halide grains is precipitated at a pAg below 5.0.

8. A photographic silver halide emulsion as claimed in claim 1, wherein the silver halide grains are chemically ripened at the surface thereof using a sulphur sensitiser.

9. A photographic recording material comprising at least one layer support, at least one photosensitive silver halide emulsion layer and, optionally, other layers, wherein an emulsion of the type claimed in claim 1 is present in at least one layer.

10. A photographic recording material as claimed in claim 9, wherein a colour coupler is present in at least one layer of the recording material.

* * * * *